United States Patent [19]

Tobisawa et al.

[11] Patent Number: 5,042,422

[45] Date of Patent: Aug. 27, 1991

[54] COATING APPARATUS

[75] Inventors: Seiichi Tobisawa; Shigetoshi Kawabe; Takemasa Namiki, all of Hino, Japan

[73] Assignee: Konica Corporation, Tokyo, Japan

[21] Appl. No.: 297,756

[22] Filed: Jan. 17, 1989

[30] Foreign Application Priority Data

Jan. 20, 1988 [JP] Japan ..... 63-10286
Jan. 20, 1988 [JP] Japan ..... 63-10287

[51] Int. Cl.[5] ..... B05C 5/00

[52] U.S. Cl. ..... 118/410; 118/419; 118/428

[58] Field of Search ..... 118/400, 407, 410, 413, 118/411, 412, 600, 672, 668, 679, 688, 419, 428; 425/378.1, 466

[56] References Cited

U.S. PATENT DOCUMENTS

| | | | |
|---|---|---|---|
| 2,784,697 | 3/1957 | Uhleen | 118/411 |
| 3,609,810 | 10/1971 | Coghill | 118/410 |
| 3,679,476 | 7/1972 | Oosterhout et al. | 118/413 |
| 4,424,762 | 1/1984 | Tanaka et al. | 118/410 |
| 4,514,348 | 4/1985 | Iguchi et al. | 425/466 |
| 4,537,801 | 8/1985 | Takeda | 427/356 |
| 4,681,062 | 7/1987 | Shibata et al. | 118/410 |
| 4,753,587 | 6/1988 | Djordjevic et al. | 425/466 |
| 4,781,562 | 11/1988 | Sano et al. | 425/466 |

FOREIGN PATENT DOCUMENTS

| | | |
|---|---|---|
| 0196029 | 10/1986 | European Pat. Off. . |
| 0224855 | 6/1987 | European Pat. Off. . |
| 3144655 | 7/1982 | Fed. Rep. of Germany . |

*Primary Examiner*—Willard E. Hoag
*Attorney, Agent, or Firm*—Jordan B. Bierman

[57] ABSTRACT

The invention provides an apparatus for coating a solution on a tape-shaped flexible support which is moved so as to run along a top surface of coating head. The coating head is slitted so as to form a front edge surface, a back edge surface in order in the moving direction of the flexible support, and a slit therebetween so that the solution is extruded through the slit of the coating head to the flexible support. In this configuration, at least a part of the back edge surface projects beyond the tangent line at the downstream end of the front edge surface.

17 Claims, 9 Drawing Sheets

COATING APPARATUS

BACKGROUND OF THE INVENTION

This invention relates to an extrusion type coating apparatus, specifically one which is capable of high speed, high viscosity coating and thin coatings for trouble-free magnetic medium coating.

Coating methods such as roll, gravure, extrusion, slide guard, curtain, and other various methods are well known.

Magnetic recording media are obtained by coating the media support with magnetic coating solution. Coating methods such as roll, gravure coat, and extrusion coat are commonly used for magnetic media. Extrusion coating provides a particularly uniform coating film thickness.

However, improvements in magnetic recording media themselves have led to use of oxide magnetic particles with high BET values and barium ferrite materials, which has increased the viscosity of the coating solution. To attain hight density, the requirements for thin film coating have been increased, and to increase productivity, the requirement for high speed coating as fast as possible have been also increased.

For previous technology used in the extrusion coat method for manufacturing mainly magnetic recording media, those on the official gazette for Japanese Patent Publication Open to Public Inspection (hereinafter referred to as Japanese Patent O.P.I. Publication) 84711/1982, 104666/1983, and 238179/1985 are known.

With the above extrusion coat method, a uniform coating film thickness can be obtained but good coating conditions can only be obtained with in a small range, and the desired coating cannot be made at the high viscosity, thin film, and high speed coating conditions described above.

Troubles which become significant problems under these types of coating conditions and especially at the time of thin film coating (about 30 μm before drying) include an exfoliation trouble in which a coating film is peeled off by a substance adhesing or sticking on a back edge surface, such as foreign matter on the media support, dust and condensed substances in coating solutions, a thickness trouble in which a thickness of coating, film becomes partially thicker, and a base waste trouble in which the base waste is generated by shaving the support with the corner at the front edge especially on the downstream side and adheres on a coated surface, etc.

Especially with a high viscosity coating solution, irregularities on the supporting member are apt to cause intersecting streaks, which in turn cause noise or output level fluctuation.

Various countermeasures have been taken against such troubles and a representative example is the technique presented in the official gazette for Japanese Patent O.P.I. Publication No. 238179/1985 (referred to as the previous technology hereinafter). In consideration of the system presented in Japanese Patent O.P.I. Publication No. 104666/1983 in which the back edge surface 2' has a triangular sectional form as shown by the imaginary line in FIG. 16, foreign matter cannot pass over it and is apt to accumulate in the liquid reservoir P, causing streaks. The back edge surface 2' in the previous technology is smoothed as shown by the solid line, and also conditions for $\theta_1$ and $\theta_2$ of the equation (1) are satisfied as follows:

$$\theta_1 < \theta_2 < 180^\circ \quad (1)$$

In this previous technology, however, the running angle of the support changes suddenly at downstream end B of the front edge surface 1' and therefore the contact pressure between the support and the coating surface of coater head concentrate the downstream end B, the front surface of the support is shaved by the downstream end B conversely, and base waste is adheres to the coated surface of the support, frequently causing trouble.

Therefore, the first objective of this invention is to provide a coating system which has less adherence of base waste.

The uniformity of film thickness of the magnetic recording medium formed by coating has a large influence on recording and reproducing characteristics.

The film thickness in the running direction can be basically controlled by the coating speed (support carrying speed) and coating solution supply speed. The film thickness in the width direction should be even if the contact strength of the support to the coater head is even in the width direction. In practice, tension in the width direction to the support during coating varies and scars or creases on the support often make the film thickness of the coating vary in the width direction. This reduces the yield rate and the quality.

However, anticipating that the film thickness will vary in the width direction, a method can be considered beforehand to make the coater head front edge and back edge surfaces uneven in the width direction. In such a case, however, the coater head should be changed for each production lot and if delicate factors which vary the film thickness occur frequently, they cannot be eliminated.

In addition, a method to generate a magnetic field to adjust the film thickness is known but only magnetic particles in the magnetic coating solution are attracted, and this method is apt to cause flocculation.

Therefore, the second objective of this invention is to provide a magnetic recording medium coating apparatus that can simplify uniform film thickness distribution in the width direction and yet not degrading the properties of the coating solution.

Recently high S/N videotapes such as S-VHS or SHG tapes are in demand and a suitable coating method for them is desired. However, when manufacturing high S/N videotapes, electromagnetic properties are reduced to about 0.5–0.6 dB in C-C/N and 0.2–0.3 dB in Y-C/N by the extrusion coat method in comparison with other coating methods.

Therefore the third objective of this invention is to provide a coating apparatus by which a magnetic recording medium with excellent electromagnetic properties can be obtained.

The coating conditions of the above described extrusion coat method were determined by repeated trial and error but efficiency was too low and the quantity was unstable.

Therefore, the inventor et al of this invention investigated what factors in the selective condition range determine the coating ability, and found that certain of the fluidity of the coating solution in the slits determines the coating ability and especially the electromagnetic properties, as well as the contour of the front edge or back edge surfaces. Especially with magnetic or metal particles with BET values of greater than 50 $m^2/g$, the fluidity of the coating solution at the slits exerts a large influence.

The inventor further found that favorable electromagnetic properties requires a solution coating speed at the outlet of the coating solution flow-out slit to be more than a given value. This condition is especially required for coating solutions involving magnetic particles or metal particles whose BET values are greater than 50m $^2/g$.

Thus, reducing the slit gap between the front edge surface and back edge surface increases the speed of the running solution under a predetermined film thickness or a predetermined coating solution flow rate.

However, as presented in the above described official document, since the slit of the conventional coating device is in parallel, the pressure loss at the slit becomes larger when the slit gap is decreased and yet the pressure variation in the course passing the slit is large.

When the coating solution preliminary shearing device which is presented in Japanese Patent Publication O.P.I. No. 54766/1985 is used so that a large pressure loss occurs, the result is as follows:—when the slit gap is less than 50 $\mu$m, the pressure acting on this device is more than 4 $kg/cm^2$ and trouble is likely to occur in the mechanical seals throughout this device and in the solution feeding system. When forming a slit, if the gap is less than 50 $\mu$m, the machining accuracy of the slit surface will cause immediate pressure variation of the coating solution which is flowing out.

If the pressure varies due to the machining accuracy as in the latter case and pressure varies due to a constant gap (even feeding pressure is difficult due to the pulsation of the pressure-feeding pump or others), the coating solution will flow out of the slit unevenly and will result in an ununiform film thickness in the sheet flow direction and width direction.

Therefore, the fourth objective of this invention is to provide a coating apparatus which achieves satisfactory electromagnetic properties for the magnetic recording medium during coating so that film thickness variation is insignificant, and pressure loss is small.

SUMMARY OF THE INVENTION

As the first objective of this invention, in order to provide a coating apparatus having less trouble due to base waste adherence, in an apparatus for extruding a coating solution continuously from the slit between the front edge and back edge of a coating head to a flexible support surface running continuously along the front edge and back edge, thereby coating the support surface with a solution, the coating head is composed so that at least part of the back edge surface projects beyond the tangent line at the downstream end of the front edge.

According to this invention, as shown in FIG. 1, since at least part of the back edge surface 2 projects from the tangent line $l_1$ at the downstream end B of the front edge surface 1, the force with which the downstream end B of the front edge surface 1 touches the support surface is shared to the surface of the back edge surface 2 through the coating solution. As a result the support surface is scarcely shaved by the downstream end B and troubles due to base waste can be remarkably reduced.

The second objective of this invention, to simplify uniform distribution of the film thickness in the width direction, is attained by providing a gap adjusting means in the above described slit with at least 3 places in the width direction so that the slit gap can be appropriately adjusted.

In this actual model, when the slit gap is adjusted using the gap adjusting means, the coating film thickness varies. Therefore, by placing the gap adjusting means in the width direction and by adjusting the gap in the width direction, film thickness in the width direction can be made even.

The second objective can be attained in the same way as described above with a heating means in which a heating mechanism to heat the coating solution passing through the above described slit is provided at 3 places in the width direction so as to control those heating temperature. That is, when the coating solution passing through the slit is heated by the heating means, the viscosity of the coating solution decreases accordingly. Coating film thickness varies depending on the viscosity.

Therefore, the film thickness in the width direction can be made uniform by providing at least 3 heating means in the width direction and by controlling the temperature of the coating solution.

The second objective can be also attained in a coating apparatus comprising a coater head to extrude coating solution continuously from the slit between the above described front edge surface and back edge surface to the surface of the flexible support running continuously along the front edge surface and back edge surface, thereby coating the above described support surface with the coating solution, a pair of guide roller disposed on the upstream and downstream sides of the coater head to push the above described support to the coater head side, and a tension adjusting means provided between the coater head and at least one guide roll to guide the support while making the width of support curved.

In such a composition, when the support is made to be a curved section by the tension adjusting means, that is, when it runs, for example, in a mountain shape with respect to width wise direction, tension becomes stronger on both sides of the support and therefore both sides hit the coater head stronger than if they were flat.

Generally, if the coater head edge surface is flat in the width direction, the tension of the support is stronger at the center and weaker on both sides. Such uneven tension can be rectified by employing a tension adjusting mechanism with a mountain-shaped guide surface as described above. The tension adjuster can be composed of a hand drum-shaped roll and is practical with respect to cost and other points. It is also advantageous since it does not influence the properties of the coating solution.

Recording means which have excellent electromagnetic properties, as the third objective of this invention, can be attained in a coating apparatus with a coater head which extrudes coating solution continuously from the slit between the above described front and back edge surface to the flexible support a surface along the same surfaces and coasts the above described support surface, and a pair of support rolls to push the above described support towards the coater head side on the upperstream and downstream sides of the coater head, when the angle, $\theta$, made by the running direction line connecting the surface of the upstream and downstream support rolls on the coater head sides and the tengential line at the downstream edge on the above-described back edge surface, is $0.5° \leqq \theta \leqq 10°$.

In this actual model, some aspects are unclear as to why the electromagnetic properties are improved but ostensibly it is because the coating solution is applied smoothly to the back edge surface by decreasing the above described $\theta$, which also reduces film thickness variation in the running direction.

The above described third objective is attained in an apparatus which extrudes coating solution continuously from a slit between the above described front edge surface and back edge surface to the flexible support surface which continuously runs along the front edge surface and back edge surface and coats the above described support surface with coating solution, when the flowing index ($\tau$) meets the following equation (1), where the outlet edge width of the slit is L, the average speed of the coating solution in the slit is v, and the average viscosity of the coating solution is $\eta$:

$$\tau=(\eta\cdot v)/L \geqq 1\times 10^4 \text{dyne/cm}^2 \quad (1)$$

The fourth objective of this invention is to provide, a coating apparatus which achieves satisfactory electromagnetic properties of the magnetic recording medium such that, film thickness variation is small, and pressure loss is low. This can be realized in an apparatus which extrudes a coating solution continuously from the slit of the above described front edge surface and back edge surface to the flexible support surface which runs continuously along said surface and applies the coating solution to the above described support surface, when at least a certain length of the slit's outlet is tapered towards the outlet end, the angle of the intersecting tapered surfaces is 3°–20°, and the outlet end gap is less than 200 $\mu$m.

In this actual model, as shown in FIG. 14, the wall 3A and 3B of the slit 3 are tapered for a certain range of the slit's outlet and their intersecting angle 1 is 3°–10°. Therefore the flow rate is higher at the slit outlet end than with parallel slit surfaces under a certain set coating solution flow rate. Therefore, while the running speed at the outlet end should be more than a certain value in order not to reduce the electromagnetic conversion characteristics of the magnetic recording medium, sufficient outlet end flow rate can be obtained and the desired electromagnetic conversion characters can be satisfied.

Since the slit wall is tapered, pressure loss is greatly reduced, even making the troubles inherent in using the above described pre-coating shearing apparatus negligible. When the slit surfaces are parallel to each other, film thickness variation in the sheet width direction can be great if the entire slit surface machining accuracy is not high. However, with this invention, the film thickness variation in the sheet width direction is influenced only by the machining accuracy at the outlet end of the slit and since desired machining accuracy is easy to maintain if limited to the slit outlet end only, film thickness variation in the sheet width direction can be reduced.

DETAILED DESCRIPTION OF THE INVENTION

This invention is described in detail below.

Figure 1:
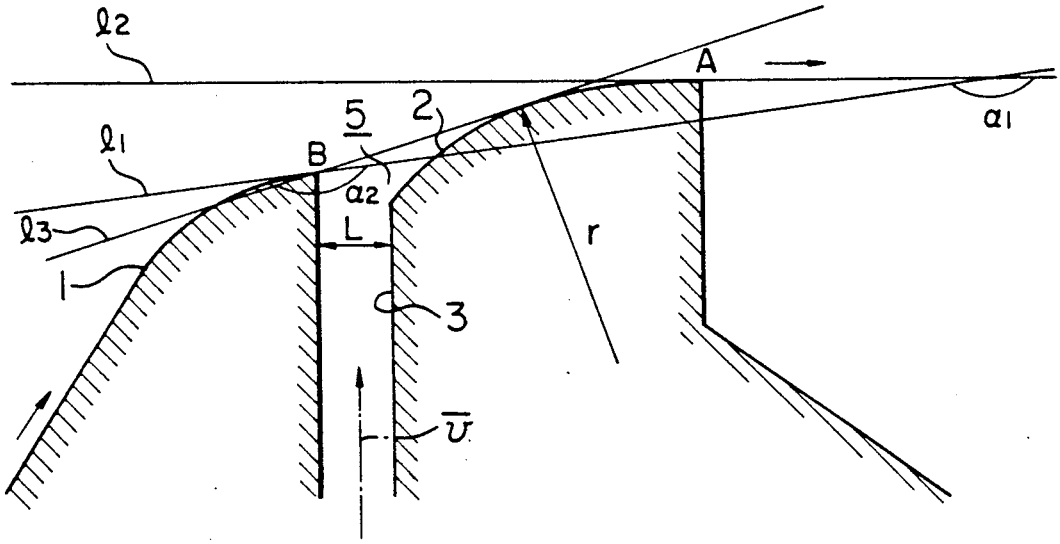
FIG. 1 is a sectional view of the major portion of the apparatus of this invention.
Figure 16:
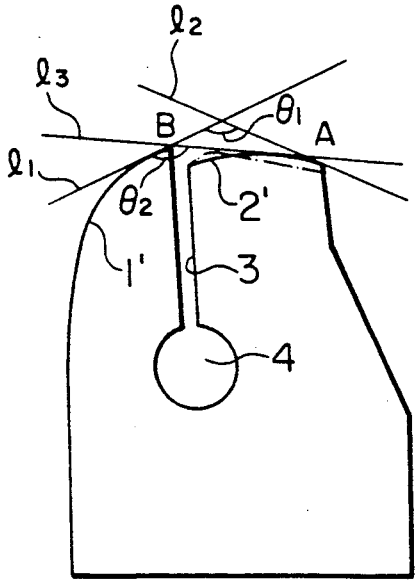
FIG. 16 is a sectional view of an entire conventional coating apparatus.

FIG. 1 shows the major part of an extruder related to this invention with front edge surface 1 on the upstream side surface and back edge surface 2 on the downstream side surface, and slit 3 between them which is interconnected with the coating solution pocket 4 (refer to FIG. 16).

In this invention, part of the back edge 2 projects (approximately upward in FIG. 1) from the tangent line 1 at the downstream end B of the front edge surface 1.

The support comes up along front edge 1 as shown by the arrow mark, passes through the downstream end B, crosses over slit 3 and solution reservoir 5, and goes to the right, moving over the coating solution tank on the back edge surface 2.

The above-mentioned conditions of this invention can be described in the following equation (2) as one preferable example, where the angle made by the above described $l_1$ and the line $l_3$, which passes through the downstream end B and contacts the back edge surface, is $\alpha_2$, and the angle made by the above-described $l_1$ and the tangent line $l_2$ at the downstream end A of the back edge surface 2 is $\alpha_1$:

$$\alpha_2 \leqq \alpha_1 \leqq 180° \quad (2)$$

Incidentally, in FIG. 1, the downstream ends A and B seem to form substantially sharp edges or sharp corners. However, it may be preferable to round off such sharp edges. In this case where the sharp edge is rounded off, the downstream end is the sharp edge point before being rounded off. Therefore, after shaping the roundness, the downstream end is obtained as a cross point between extension lines of surfaces being not rounded off. Optimum radius of curvature of the back edge surface 2 is 3–10 mm. As used herein, "upstream" and "downstream" are relative to the direction of movement of the support.

For the support needed in this invention, plastic film such as polyester film, etc., paper, their laminated sheets, metal sheets, etc., and any plastic materials, can be used.

The effect of this invention is clearly manifested in the magnetic coating solution, especially one of more than 1000 cps (measured value of B type viscometer with 60 turns, after 1 minute), but a photosensitive coating solution may be used.

For the coating speed, the best effect is manifested at speeds as high as 150 m/minute or more.

Comparison Test (1)

The effects of this invention are described below using an example for comparison.

Using polyester terephthalate film of 15 μm as support, a magnetic coating solution with a viscosity as high as 3000 cps with metal powder (BET value 60 $m^3/g$) was coated 30 μm in a wet film thickness and magnetic recording medium sheet was obtained.

A coating apparatus of this invention as described above and a coating apparatus of the previous technology as shown in FIG. 16 were prepared and their coating ability was investigated changing the coating speed. The result is as shown in Table 1.

Coating was conducted for 10000 m and coating ability was evaluated by counting the number of streaks and the adherence number of base waste (average number per width 1 m and length 10 m).

TABLE 1

| Coating speed | Previous technology | | Apparatus of this invention | |
|---|---|---|---|---|
| | Streaks | Adhered base waste | Streaks | Adhered base waste |
| 100 m/min. | 0 | 101 | 0 | 9 |
| 150 m/min. | 1 | 243 | 0 | 21 |
| 200 m/min | 2 | 504 | 1 | 23 |

According to the above table, streaks are less in the equipment using this invention and in addition, the frequency of base waste adherence is remarkably reduced even at high speed coating in comparison with the equipment of the previous technology.

Figure 2:
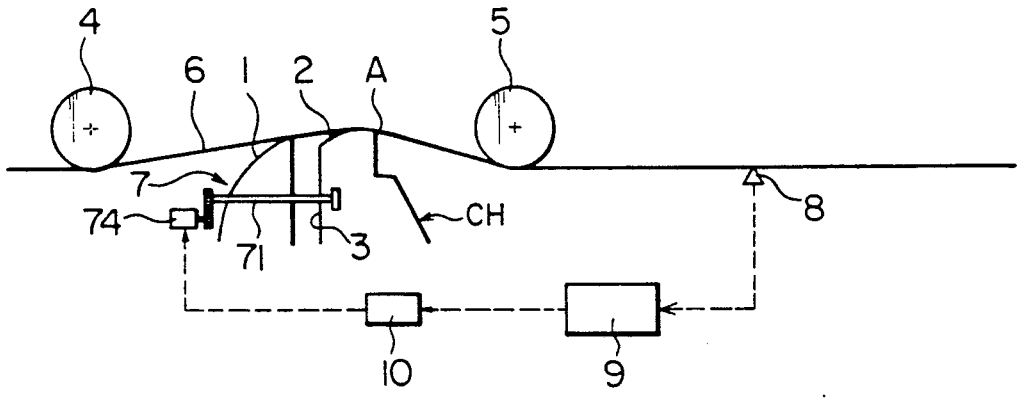
FIG. 2 is a general view of the coating apparatus of this invention.

As described above, base waste adherence and the resulting problems can be reduced and the first objective of a high speed, high viscosity coating, can be attained in this actual model. FIG. 2 shows an actual model attaining the second objective of this invention using the coater head CH in FIG. 1, by arranging the support rolls 4 and 5 on the upstream and downstream sides of the coater head CH as shown in the figure, support 6 passes through the upstream support roll 4, goes along the front edge surface 1 and back edge surface 2, passes through the downstream support roll 5 and is led downstream.

At this time, since the coater head CH projects from the supporter running direction line, support 6 is pushed against the front edge surface 1 and back edge surface 2.

Figure 3:
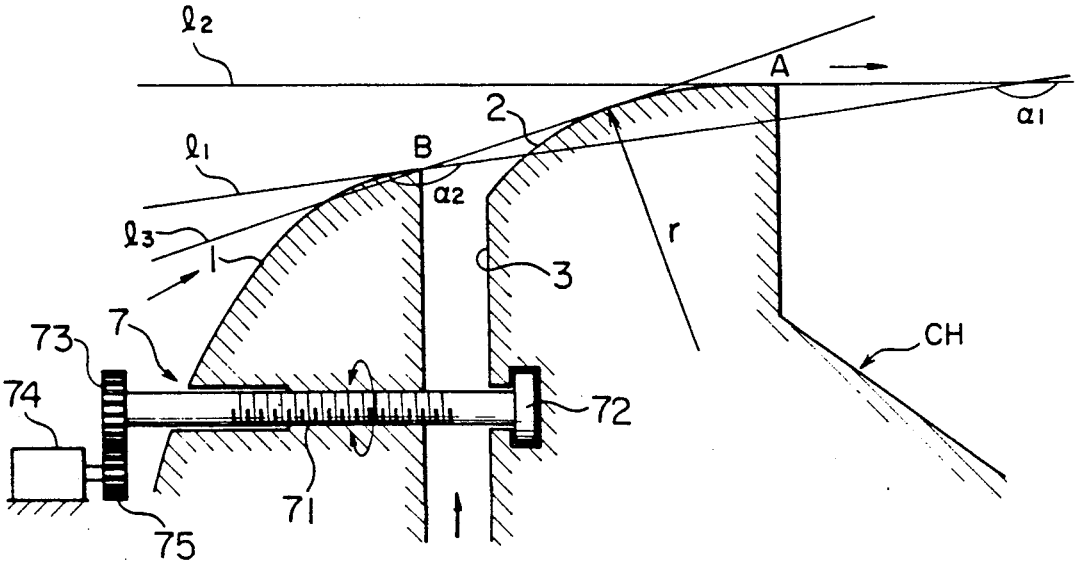
FIG. 3 is an expanded sectional view of the major portion of the coater head.
Figure 4:
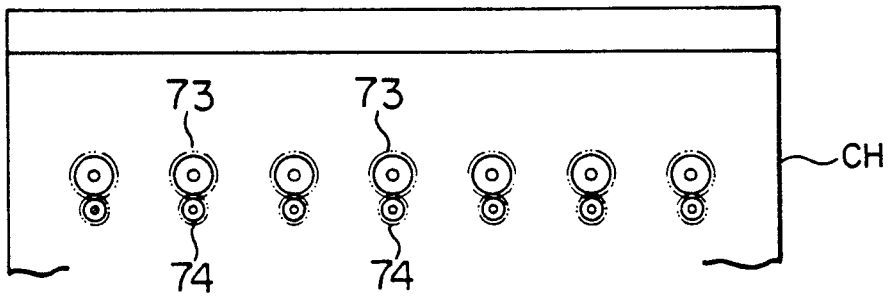
FIG. 4 is an explanatory drawing of an arrangement of the gap adjusting means.

In the actual model in FIG. 2, gap adjusting means 7 to set the gap of the above described slit 3 is provided at slit 3 to attain the second objective. An example is shown in FIG. 3, in which adjustment of the threaded bar 71 is provided through the front edge, its head 72 is freely fitted to the back edge, the base is integrated with the drive gear 73 and drive gear 75, integrated with the output shaft of the stepping motor fixed to the ground, is engaged with the drive gear 73. At least 3 such gap adjusting means 7 are provided side by side in the width direction of support 6, that is the width direction of the coater head CH. FIG. 4 shows an example of such gap adjusting means, 7 in this example, installed side by side.

When stepping motor 74 is started and threaded rod 71 is turned clockwise a viewed from the left side in FIG. 3, the head 72 is pulled to the left and the gap of slit 3 is reduced. Conversely, when it is turned clockwise, the gap of the slit 3 becomes larger. The gap of slit 3 is adjusted in the width direction of the coater head CH.

However, film thickness gauge 8 (an X-ray film thickness gauge) is provided on the outside of the coater head CH and information on coating film thickness obtained by this film thickness gauge 8 is supplied to computing unit 9.

Computing unit 9 outputs correction signal to motor controller 10 attached to each gap adjusting means 7, 7 . . . to make the current film thickness distribution in the width direction even. At this time, computing unit 9 outputs a correction signal based on the current slit gap, current viscosity of coating solution, coating solution flow rate, desired film thickness, and coating speed, detected using the current rotating angle (current position) of the adjusting threaded bar, Magnetscale (trade name, not illustrated), based on output of the stepping motor 74.

This feedback control evens width direction distribution of the film thickness.

In FIG. 3, the gap adjusting means is a threaded bar but the slit gap may be adjusted by a pushing force or return force on the front edge and/or back edge with a cylinder. Also, the slit gap may be adjusted by human force. For instance, in the example FIG. 3, a hexagon wrench hole may be drilled at the base of the adjusting threaded bar 71 to turn the adjusting threaded bar by the hexagon wrench to advance or retract it. The gap may also be adjusted by providing a gap adjusting member with a different thermal expansion coefficient from that of the front edge and back edges, extending over the said edges through the slit, arranging a heater in the inside, converting the signal from the film thickness gauge to the temperature control signal to adjust the heater temperature, and thereby expand or contract the gap adjusting member.

Since the coating film thickness varies in the width direction at the center and on both sides, at least 3 means to adjust the gap are necessary.

Comparison Test (2)

The effects of this invention are clarified clear below by an example of comparison.

Using 15 μm thick, 1000 mm length polyethylene terephthalate film, a magnetic recording medium sheet was obtained by coating with a magnetic coating solution of 3000 cps with metal particles (BET value 60 $m^3/g$) to 15 μm in wet film thickness.

At this time, film thickness distribution in the width direction was compared using the coating apparatus of this invention as shown in the figure. The same coating apparatus without gap adjustment was installed.

According to this result, the ability to make uniform film thickness in the width direction is improved in the coating apparatus with gap adjustment.

Figure 5:
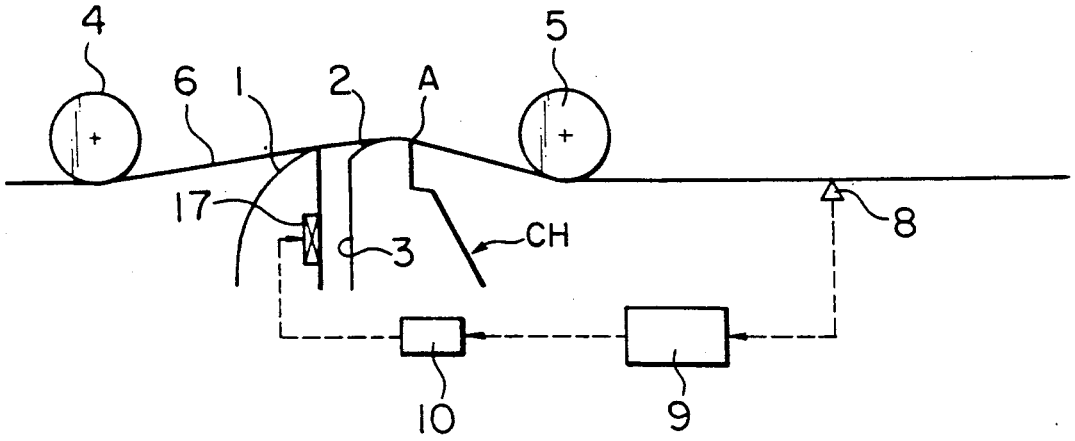
FIGS. 5–7 are explanatory drawings of heater arrangement.
Figure 6:
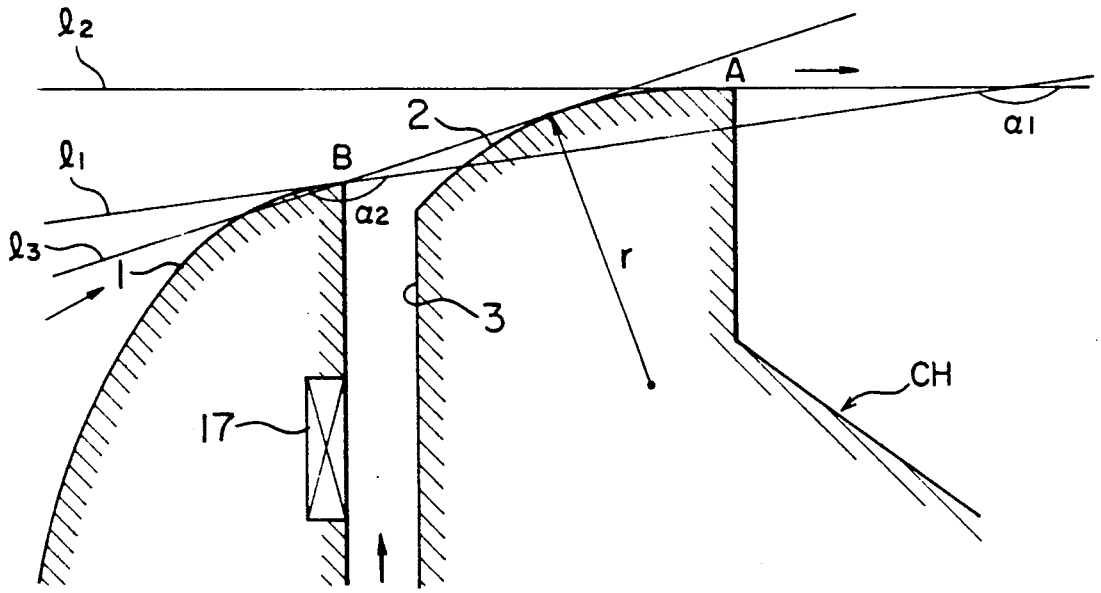
Figure 7:
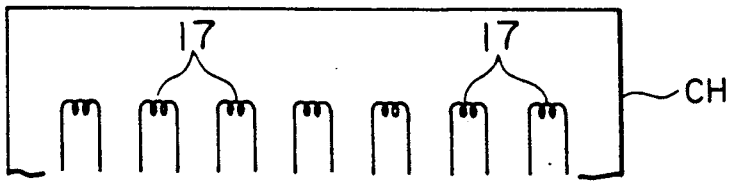

FIGS. 5 to 7 show another actual model to attain the second object. As shown in the figures, at least more than 3, 7 in the example in the figures, heaters 17, 17 . . . as the heating means of this invention are arranged at equal intervals in the width direction of the support, that is in the width direction of the coater head CH, directly to the above described slit 3 or indirectly through the coater head CH forming member.

In the same way as in the actual model in FIG. 2 a film thickness gauge 8, such as an X-ray film thickness gauge, is provided on the outlet side of the coater head CH, and information on coating film thickness obtained by this film thickness gauge 8 is taken into the computing unit 9.

Computing unit 9 outputs a correction signal to each temperature adjusting apparatus 10 attached to each heater 17 to make the current film thickness distribution in the width direction even according to the coating film thickness signal. At this time, computing unit 9 outputs a correction signal based on the current power supply volume, current viscosity of the coating solution, coating solution flow rate, desired film thickness, and coating, etc. as well as the current film thickness distribution.

Using the feedback control, film thickness distribution is made even in the width direction.

Heater 17 may be provided on the back edge side. Multiple numbers may be provided in the direction towards to outlet of slit 3. Since the film thickness varies at the center and both sides in the width direction, at least 3 heaters are required in the width direction.

Comparison Test (3)

The effect of this invention is clarified by an example of comparison.

Using a 15 μm thick, 1000 mm length of polyethylene terephthalate film, a magnetic recording medium sheet was obtained by high viscosity magnetic coating solution of 2500 cps with metal particles (BET value 60 $m^3/g$) to wet film of 15 μm in thickness.

Film thickness distribution in the width direction was compared using the coating apparatus of this invention as shown in the figure and an identical coating apparatus without heating.

Figure 8:
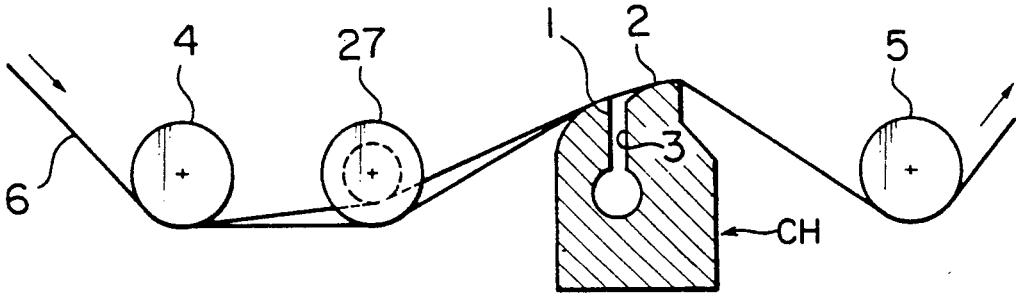
FIG. 8 is an overall view of a coating apparatus with tension rolls arranged according to this invention.
Figure 9:
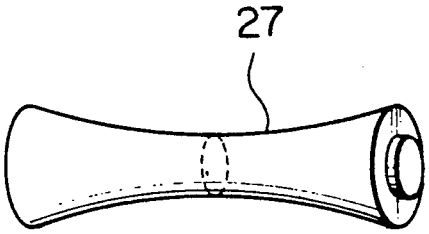
FIG. 9 is a view of the tension adjusting roll.

According to this result, this ability to make the film thickness in the width direction even is improved in the coating apparatus with a heating means. FIGS. 8 and 9 show still another actual model to attain the second object. A hand drum-shaped tension adjusting roll 27 is provided between the coater head CH and upstream guide roll 4 and support 6 is pushed and guided by adjusting roll 27.

Since support 6 passes through third adjusting roll 27, tension on both sides of the support 6 becomes stronger than the tension at the center. Therefore, the coating film is thinner on both sides.

When the edge surfaces 1 and 2 of the coater head CH are flat in the width direction, there is a tendency for the film to become thinner at the center and thicker on both sides, but using the above described adjusting roll 27, tension of the support is made even in the width direction and therefore the coating film thickness is also made even.

Figure 10:
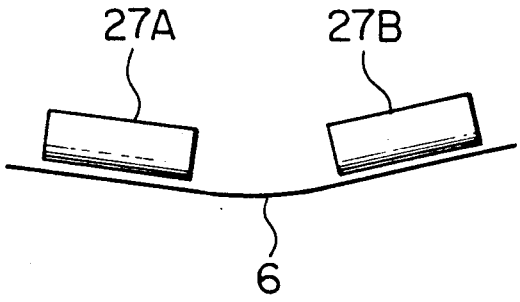
FIGS. 10 and 11 are front view and perspectives of other tension adjusting rolls.

Instead of using the hand drum-shaped adjusting roll 27 described above, unit adjusting rolls 27A and 27B arranged in recessed configuration as shown in FIG. 10 may be pushed against support 6 as another preferable embodiment.

Figure 11:
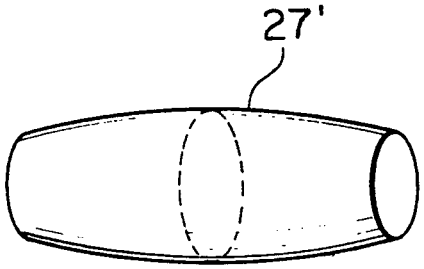

By providing above described hand drum shaped adjusting roll 27 and the drum-shaped adjusting roll 27' as shown in FIG. 11 side by side along the running direction of the supporter 6 so as to guide the support so that tension can be controlled more accurately in the width direction than when using one adjusting roll. On the other hand, when the edge surface of the coater head CH is recessed, the drum-shaped adjusting roll 27' may be used independently.

When these rolls are movable and the degree that they are pushed against the support is adjustable, they can sufficiently cope with different lots or factors varying the film thickness in a lot. In addition, uneven film thickness in the support width direction can be adjusted by pushing those rolls obliquely against the support.

The above adjusting rolls may be provided between the coater head CH and downstream guide roll 5. The tension adjusting means may not be a roll and may be the bottom of the secured block formed in the projected configuration. In this case, support 6 runs on the bottom surface in sliding contact with it.

Comparison Test (4)

Effects of this invention are made clear below by an actual model.

Using a 15 μm thick, 1000 mm length of polyethylene terephthalate film a magnetic recording medium sheet was obtained by coating with a 3000 cps magnetic coating solution having metal particles (BET value 60 $m^3/g$) to wet film of 15 μm in thickness.

At this time, film thickness distribution in the width direction was compared using the coating apparatus of this invention as shown in FIGS. 8 and 9 and using the same coating apparatus without tension control.

According to this result, the ability to make film thickness even in the width direction is improved by the arrangement as shown in FIGS. 8 and 9.

Figure 12:
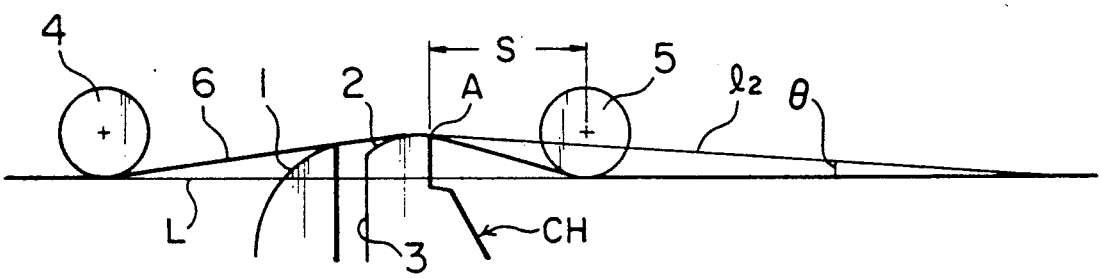
FIG. 12 is a general view showing the relation of the support rolls to the coating apparatus of this invention and FIG. 13 is a correlation diagram of the flow index and electromagnetic convertion characteristics of this invention.

An actual model to obtain a recording medium excellent in electromagnetic properties, which is the third objective of this invention, is described below. In this actual model as shown in FIG. 12, angle made by the running direction L of the above-described support 6 and the tangent line $l_2$ at the downstream edge A of the back edge surface 2 should satisfy the condition of the equation (1).

$$0.5 \leqq \theta \leqq 10^\circ \quad (1)$$

When $\theta$ is under 0.5, sufficient pushing force of support 6 to the coater head CH cannot be obtained, and streaks are easily formed. When $\theta$ exceeds 10°, uniformity of the coating film cannot be obtained and variation of film thickness in the sheet length direction increases.

The distance between the downstream end A of the back edge surface 2 and the center of the downstream support roll 5 should be between 5 and 100 mm. When it is below 5 mm, support 6 may turn direction suddenly at the downstream end A on the back edge surface and flatness of the coating film is damaged, or when it exceeds 100 mm, the pushing force of the support 6 is reduced, leading to variation in film thickness.

The progressing direction of support 6 to the upstream support roll 4 and the direction after leaving the downstream support roll 5 are not limited.

Comparison Test (5)

Effects of this invention are made clear below by an example for comparison.

Using a 15 μm thick polyethylene terephthalate film, the magnetic recording medium sheet was obtained by coating with a high viscosity magnetic coating solution of 3000 cps having metal particles (BET value 60 $m^3/g$) to wet film of 30 μm in thickness.

At this time, electromagnetic properties were investigated with respective to $\theta$ and S by changing the positions of the downstream support roll 5 in the above described coating apparatus of this invention. The result is shown in Table 2.

TABLE 2

| | Example data 1 | Example data 2 | Example data 3 | Example data 4 | Comparative data |
|---|---|---|---|---|---|
| Angle (°) | 0.7 | 3° | 8° | 11° | 0.2° |
| Gap S (mm) | 70 mm | 40 mm | 90 mm | 60 mm | 60 mm |
| RF out | +0.5 dB | +0.5 dB | +0.5 dB | 0 | ***— |
| Lumi S/N | +0.5 dB | +0.5 dB | +0.4 dB | 0 | — |
| *Ra | 0.010 | 0.010 μm | 0.010 μm | 0.012 μm | — |
| **Variation of audio output | 0.3 dB | 0.2 dB | 0.4 dB | 0.6 dB | — |

*Ra shows surface roughness prescribed by JIS B 0601.
**Variation in audio output is measured value at 333Hz.
***Coating could not be carried out due to heavy streak.

Coating film uniformity is favorable in this invention and therefore favorable RF out and Lumi S/N values are anticipated. A small variation in the audio output is considered because of the small variation of the film thickness in the sheet length direction.

As described above, a magnetic recording medium with excellent electromagnetic properties can be manufactured with this invention.

The third objective of the coating solution flow index which obtains favorable electromagnetic properties of the magnetic recording medium is described below.

In FIG. 1, the above described third objective is attained since the flow index prescribed in this invention satisfies the above described equation (b 1), where the width of the wall of slit 3 is L, average flow speed of the coating solution is v, and average viscosity of the coating solution is n. This condition is required because the electromagnetic conversion characteristics are inferior under $10^4$ dyne/cm$^2$., as described in later details of the actual model.

The average flow velocity can be measured easily in this invention since the magnetic coating solution can be handled in the same way as laminar flow. For the coating solution viscosity, the measurement value of a B type viscometer after 60 revolutions, 1 minute (at room temperature) can be used.

Comparison Test (6)

The effects of this invention are shown in the actual model below.

Using polyester terephthalate of 15 μm as the support, magnetic coating solutions of various viscosity with metal powder (BET value 60 m$^3$/g) were coated changing the slit width and average flow velocity to obtain 100 μm of wet film thickness in the coating apparatus in FIG. 1 in order to produce a magnetic recording medium sheet.

Electromagnetic conversion characteristics of the sheet obtained were investigated. The result is shown in Table 3 and FIG. 13.

Figure 13:
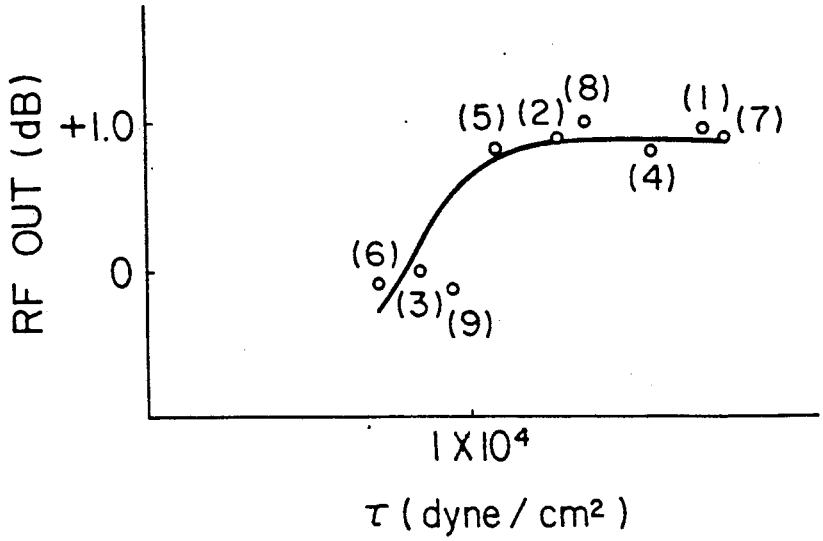

As shown in FIG. 13, it is known that the electromagnetic properties can be sufficiently satisfied by $\tau \leqq 1 \times 10^4$ dyne/cm$^2$.

When other types of coating apparatuses were used, the same tendency was seen.

As described above, design standards are specified for the coating apparatus and sufficient electromagnetic properties of the magnetic recording media obtained can be constantly obtained with this invention. A model of the fourth objective to obtain sufficient flow velocity with small pressure loss, is described below.

TABLE 3

| No. | Slit width L (cm) | Velocity v (cm/sec) | Viscosity $\eta$ (dyn.sec/cm$^2$) | Flow Index $\tau$ (dyne/cm$^2$) |
|---|---|---|---|---|
| 1 | 0.005 | 31.25 | 5.0 | $3.125 \times 10^4$ |
| 2 | 0.010 | 31.25 | 5.0 | $1.56 \times 10^4$ |
| 3 | 0.030 | 31.25 | 5.0 | $5.21 \times 10^4$ |
| 4 | 0.005 | 6.25 | 20.0 | $2.50 \times 10^4$ |
| 5 | 0.010 | 6.25 | 20.0 | $1.25 \times 10^4$ |
| 6 | 0.030 | 6.25 | 20.0 | $4.17 \times 10^4$ |
| 7 | 0.005 | 3.0 | 60.0 | $3.60 \times 10^4$ |
| 8 | 0.010 | 3.0 | 60.0 | $1.80 \times 10^4$ |
| 9 | 0.030 | 3.0 | 60.0 | $6.00 \times 10^3$ |
| 10 | 0.030 | 10.0 | 60.0 | $2.00 \times 10^4$ |

Figure 14:
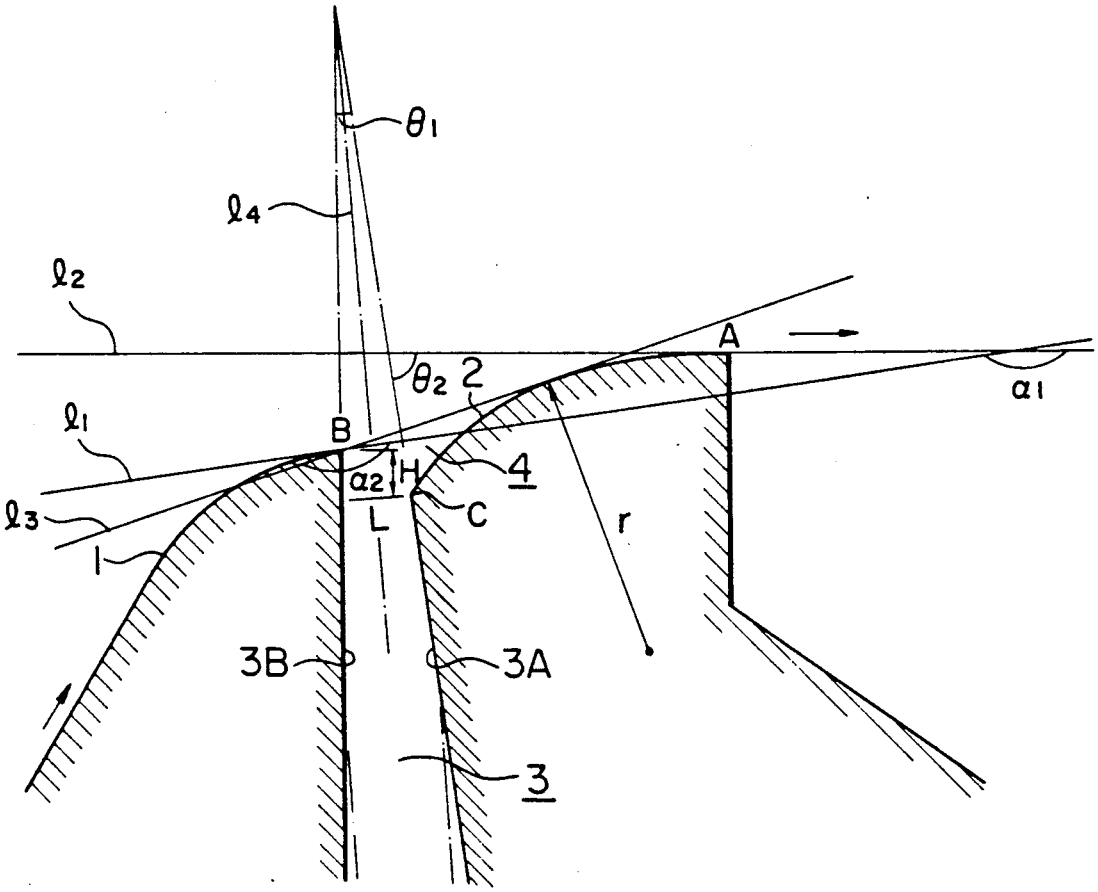
FIG. 14 is a sectional view of a major part presenting a with an inclined slit according to this invention.

FIG. 14 shows the main portion of the extruder used in this actual model, with front edge surface 1 on the surface on the upstream side, back edge surface 2 on the surface on the downstream side, and slit 3 between them interconnecting with the coating solution pocket.

In this invention, the wall surfaces 3A and 3B of slit 3 are tapered and their intersecting angle $\theta$ is 3°-20°. If this angle is below 3°, previous problems will occur and if it exceeds 20°, stable flow velocity is difficult to obtain. The interval L measured at the outlet end of slit 3 measured in the direction passing through the border edge between either the edge surface 1 or 2 of both of them (border edge C to the back edge surface 2 in the example in the figure) and intersecting the center line $l_4$ of slit 3 at a right angle should be less than 100 'μm, and optimally less than 50 μm.

The relation between the line drawn in parallel with the line passing through the downstream edge B including gap L and the length of the border edge C should be $H<L$.

As shown by the imaginary line in FIG. 14, slit 3 is in parallel at the base and thus the whole surface should not be necessarily tapered.

Comparison Test (7)

Using polyester terephthalate film of 15 μm as the support, a high viscosity magnetic coating solution of 3000 cps with metal particles (BET value 60 m$^3$/g) was coated on wet film of 30 μm thickness to obtain the magnetic recording medium sheet.

At this time, the above described coating apparatus of this invention and a coating apparatus as presented in the official gazette for the patent publication No. SHO60-238179 were prepared, with slit gaps (the slit gap of the actual model is D as described above) of 50 μm and 100 μm. Electromagnetic properties RF out, variation of film thickness in the width direction and pressure loss at the time of coating the obtained sheet were investigated and the result shown in Table 4 was obtained.

As shown above, the ununiform film thickness in the width direction is small and pressure loss is low using the apparatus of this invention without reducing the electromagnetic conversion characteristics.

As described above, in this invention, ununiform film thickness in the width direction of the obtained sheet and the pressure loss may be small without deteriorating the electromagnetic conversion characteristics.

An example of modification of the extruder of this invention as shown in FIG. 1 is described below.

As may be presumed from FIG. 16 showing the above described previous technology, the air involved between the surface of the support and front edge surface 1'0 when the support runs is prevented from being mixed in the coating solution by squeezing at the downstream end B of the front edge surface 1'. However, this causes the base waste to adhere as described above. The inventor et al. of this

TABLE 4

| Slit gap | 50 μm | 100 μm |
|---|---|---|
| Comparative data | | |
| RF out | 0 dB | −0.2 dB |
| Variation of film thickness | ±15% | ±8% |
| Pressure loss | 4 kgf/cm$^2$ | 2.2 kgf/cm$^2$ |
| Example data | | |
| RF out | 0 dB | −0.2 dB |
| Variation of film thickness | ±5% | ±2% |
| Pressure loss | 2 kgf/cm$^2$ | 1.2 kgf/cm$^2$ |

invention found it effective to break up the touching force of the support to the back edge surface by projecting at least a part of the back edge surface from the contact point $l_1$ at the downstream end B of the front edge surface. However, there is a tendency that the contact force between the downstream end B and support becomes weak correspondingly, and especially when the support running speed is high to a certain degree, the volume of the air flowing in at the film boundary on the support surface increases, mixture of the air into the coating solution cannot be prevented completely, and pin holes appear in the sheet after coating.

Therefore, the inventor et al. of this invention made improvement as follows to provide a coating apparatus which can prevent shaving of the base, reduce pin hole trouble and others.

An apparatus to extrude coating solution continuously from the slit between the front edge surface and back edge surface to a flexible support surface which runs continuously along the front edge surface and back edge surface and coats the above described support surface, was composed so that the final end of the front edge surface has a linear area connecting the downstream end of the front edge surface, a linear area length less than 1 mm, and at least a part of the back edge surface projected beyond the extension line of the above described linear area.

Figure 15:
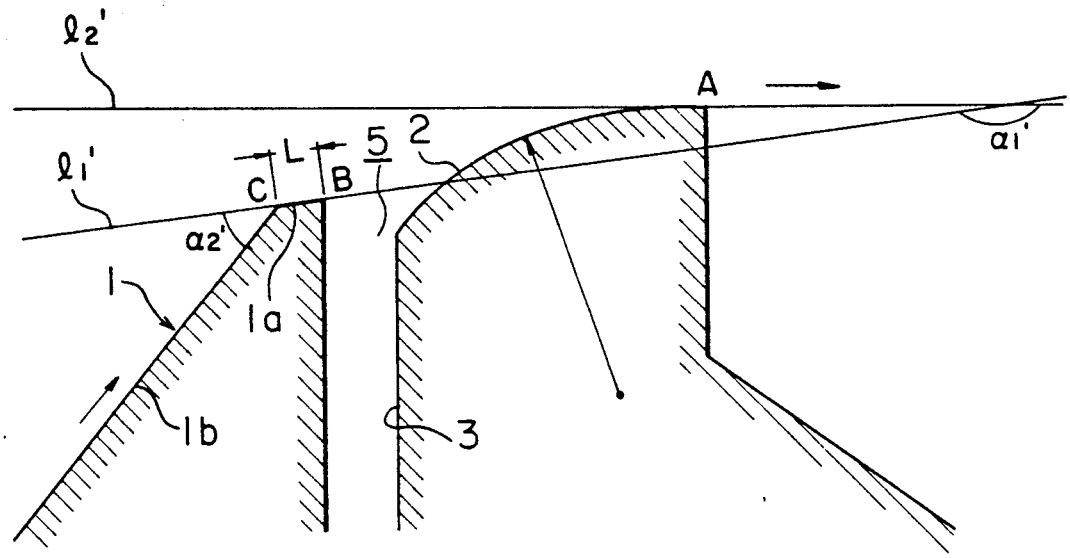
FIG. 15 is a sectional view of the major part showing a modification of the apparatus according to this invention.

In this actual model, as shown in FIG. 15, at least a part of the back edge surface 2 projects from the tangent line $l'_1$ at the downstream end B of the front edge surface 1 and therefore the force of the downstream end B of the front edge surface 1 when touching the support surface is broken up through the coating solution to the surface of the back edge surface 2. As a result, the support surface is shaved little by the downstream end B and base waste trouble can be remarkably reduced.

Since there is linear area 1*a*, the support touches strongly at the border edge C of the introducing surface 1*b* and linear area 1*a* when the support runs, the support is squeezed at the border edge, and air is prevented from interfering in the film at the border. This reduces troubles due to pin holes.

This actual model is described below in further detail. In this actual model, the introducing surface 1*b* for the front edge surface may be curved but optimally, it should be flat, linear area la should be formed between the border edge C at its final end and downstream end B of the front edge surface 1, and the linear area length L should be less than 1 mm. A part of the back edge 2 is projected (approximately upward in FIG. 15) from the extension line $l'_1$ of the linear area 1*a* passing through the downstream end B. However, it does not naturally project from the extension line of the introducing surface 1*b*.

Here, the angle $\alpha'_1$ at which the extension line $l'_1$ becomes the tangent line $l'_2$ at the final end of the back edge surface 2 should be optimally less than 10°. The radius of curvature, r, of the back edge surface 2 should be optimally 3–10 mm.

The angle $\alpha'_2$ made by the introducing surface lb and extension line lb should be optimally 20°–80°. The support comes up along the front edge surface $\mathbf{1b_1}$ as shown by the arrow mark, turns direction at the border line edge C, passes through the downstream end B, crosses over the slit 3 and solution reservoir 5, and goes through to the right moving over the coating solution layer.

When L exceeds 1 mm, the support is apt to be raised from the border edge C by the pressure of the coating solution, possibly allowing the air at the film at the border to be mixed.

Comparison Test (8)

The effects of this invention are shown in a model.

Using polyester terephthalate film of 15 μm as the support, high viscosity magnetic coating solution of 4000 cps with metal particles (BET value 60 m$^3$/g) was coated in 10 m in wet film thickness to obtain the magnetic recording medium sheet.

At this time, the above described coating apparatus of this invention and a coating apparatus of the previous technology were prepared, coating efficiency was investigated changing the coating speed, and the result as shown in Table 5 was obtained.

Coating was conducted for 10000 m respectively and the coating efficiency was evaluated by counting the number of pin holes, streaks, and adherence of base waste for the entire length.

According to the above result, pin holes and streaks were less even at high viscosity and super thin film under conditions of not so high coating speed in the apparatus of this invention and in addition, the frequency of base waste adherence is remarkably reduced in comparison with the apparatus of the previous technology.

As described above, generation of pin holes, streaks, and adherence of base waste can be reduced in this actual model and coating of thin film of high viscosity can be attained.

TABLE 5

| Coating speed | 50 m/min. | 100 m/min. | 150 m/min. | 200 m/min. |
|---|---|---|---|---|
| Comparative data | | | | |
| Pin hole | 100 | 112 | 198 | 280 |
| Streaks | 0 | 10 | 14 | 27 |
| Attachment of base waste | 55 | 104 | 116 | 151 |
| Example data | | | | |
| Pin hole | 0 | 0 | 5 | * |
| Streaks | 0 | 0 | 2 | * |
| Attachment of base | 5 | 11 | 14 | * |

TABLE 5-continued

| Coating speed | 50 m/min. | 100 m/min. | 150 m/min. | 200 m/min. |
|---|---|---|---|---|
| waste | | | | |

*Because the coating speed was too fast, coating was impossible.

What is claimed is:

1. An apparatus for regulating the thickness of a coating of a solution on a flexible support which comprises means for moving said support in contact with a coating head of said apparatus in a downstream direction transverse to a coating slit in said head, said coating head having an upstream surface, a downstream surface downstream of said upstream surface, and a slit defined between said upstream surface and said downstream surface, whereby said apparatus extrudes said solution through said slit onto said flexible support, said downstream surface being curved, at least a part of said downstream surface projecting beyond a tangent line which is tangent to said upstream surface at a downstream end thereof, and downstream ends of said upstream surface and said downstream surface each forming an edge.

2. The apparatus of claim 1 further comprising slit means for causing flow index to satisfy the equation:

$$=(n\cdot v)/L \geqq 1\times 10^4 \text{dynes/cm}^2$$

wherein L is a width of said slit at an outlet end thereof in centimeters, v is an average flow speed in centimeters per second of said solution in said slit, and n is an average viscosity of said solution in dyne seconds per square centimeter, said surfaces defining said slit diverge toward said outlet end, and form an intersecting angle of said surfaces of 3°-20°.

3. The apparatus of claim 1 wherein an upstream end of said downstream surface adjacent the slit is lower than said downstream end of said upstream surface.

4. The apparatus of claim 3 wherein the upstream surface has a flat upstream area adjacent said slit.

5. The apparatus of claim 4 wherein the length of said flat upstream area in said downstream direction is not longer than 1 mm.

6. The apparatus of claim 3 wherein surfaces defining said slit diverge toward its outlet end, and form an intersecting angle of said surfaces of 3°-20°.

7. The apparatus of claim 6 wherein L is less than 100 μm.

8. The apparatus of claim 3 further comprising regulating means for regulating the width of said slit.

9. The apparatus of claim 8 wherein said regulating means comprises at least three sets of regulating members disposed transversely to said downstream direction.

10. The apparatus of claim 3 further comprising means for heating said solution passing through said slit.

11. The apparatus of claim 10 wherein said heating means has at least three sets of heating members disposed transversely to said downstream direction.

12. The apparatus of claim 3 wherein support rollers are located upstream of said upstream surface and downstream of said downstream surface and disposed so that said flexible support is pressed onto said coating surface.

13. The apparatus of claim 12 wherein an angle $\theta$ between a first line tangent to both said rollers on a side nearer said flexible support and a second line tangent to said downstream surface at a downstream end thereof satisfies the formula $$0.5 \leqq 0 \leqq 10°$$

14. The apparatus of claim 12 wherein a tension means for regulating tension exerted on said flexible support is located between said coating head and one of said support rollers.

15. The apparatus of claim 14 wherein said tension means comprises at least one roller having a contact surface curved transversely to said downstream direction.

16. The apparatus of claim 15 wherein said contact surface is concave.

17. The apparatus of claim 14 wherein said contact surface is convex.

* * * * *